US005964074A

United States Patent [19]

Suzuki et al.

[11] Patent Number: 5,964,074

[45] Date of Patent: Oct. 12, 1999

[54] COOKING APPARATUS

[75] Inventors: Katsuhiko Suzuki; Ikuo Kuroda; Ryoji Sekine; Masahiro Kobayashi, all of Gunma-ken, Japan

[73] Assignee: Sanyo Electric Co., Ltd, Osaka, Japan

[21] Appl. No.: 09/052,626

[22] Filed: Mar. 31, 1998

[30] Foreign Application Priority Data

Mar. 31, 1997 [JP] Japan ..... 9-094463

[51] Int. Cl.[6] ..... B65B 51/14

[52] U.S. Cl. ..... 53/127; 53/284.7

[58] Field of Search ..... 99/165; 53/127, 53/512, 284.7, 374.4, 375.3

[56] References Cited

U.S. PATENT DOCUMENTS

| | | | |
|---|---|---|---|
| 3,607,312 | 9/1971 | Ready | 99/165 |
| 3,615,711 | 10/1971 | Markus et al. | 99/171 H |
| 3,966,980 | 6/1976 | McGuckian | 426/393 |
| 4,144,693 | 3/1979 | Ogata | 53/433 |
| 4,218,486 | 8/1980 | Bieler et al. | 426/412 |
| 4,249,388 | 2/1981 | Burns | 62/185 |
| 4,369,611 | 1/1983 | Canfield | 53/127 |
| 4,457,348 | 7/1984 | Mueller et al. | 141/1 |
| 4,634,333 | 1/1987 | Butterly et al. | 414/331 |
| 4,676,279 | 6/1987 | Von Lersner | 141/1 |
| 5,112,477 | 5/1992 | Hamlin | 210/85 |
| 5,163,270 | 11/1992 | Treiber | 53/415 |
| 5,457,826 | 10/1995 | Haraga et al. | 4/451.4 |

*Primary Examiner*—Joseph J. Hail, III
*Assistant Examiner*—Dermott Cooke
*Attorney, Agent, or Firm*—Darby & Darby

[57] ABSTRACT

It is an object of the present invention to provide a cooking apparatus which is suitable for an installation in a kitchen and cooks, bags and cools food without the use of a metallic clip. The cooking apparatus comprises a kettle for cooking food by heat, a bagging table for bagging the food cooked by the kettle, a carrying pump for carrying the food cooked by the kettle, a filling valve disposed on the bagging table and for filling the food carried by the carrying pump in a bag, a heat welding type sealer disposed on the bagging table and for heating and sealing an opening side end of the bag filled with the food by the filling valve, and a cooling device for cooling the bag sealed by the heat welding type sealer.

8 Claims, 8 Drawing Sheets

COOKING APPARATUS

BACKGROUND OF THE INVENTION

The present invention relates to a cooking apparatus for cooking, bagging and cooling food in a kitchen or the like.

This type of kitchen cooking apparatus has been heretofore installed in a hospital kitchen and a restaurant kitchen. This cooking apparatus cooks, bags and cools about 500–3000 servings of food at a time. Thus, in the kitchen for producing relatively many kinds of and a small quantity of foods, it is not possible, due to cost and available installation space, to install the large-scale cooking apparatus installed in a food processing center or the like used for producing a few kinds of and a large quantity of ten thousands of servings of food. Therefore, in the conventional kitchen cooking apparatus, in order that the scale of the apparatus is not to be enlarged, after the food is filled in a bag, an opening side end of the bag is throttled and is fastened with a metallic clip.

However, this clip is sometimes mixed into the bag. This causes a problem in a food sanitation. Furthermore, since the bag is throttled on the opening side end thereof, the bag filled with the food is rounded in shape and becomes thicker. This causes cooling efficiency to be decreased.

SUMMARY OF THE INVENTION

The present invention is made in order to solve the above problems. It is an object of the present invention to provide a cooking apparatus which is suitable for an installation in a kitchen and cooks, bags and cools food without the use of a metallic clip.

A cooking apparatus of the present invention comprises: a kettle for cooking food by heat; a carrying pump for carrying the food cooked by the kettle; a filling portion for filling the food carried by the carrying pump in a bag; a heat welding type sealer for heating and sealing an opening side of the bag filled with the food by the filling portion; and a cooling device for cooling the bag sealed by the heat welding type sealer.

A cooking apparatus of the present invention further comprises: a kettle for cooking food by heat; a bagging table for bagging the food cooked by the kettle; a carrying pump for carrying the food cooked by the kettle; a filling valve disposed on the bagging table and for filling the food carried by the carrying pump in a bag; a heat welding type sealer disposed on the bagging table and for heating and sealing an opening side end of the bag filled with the food by the filling valve; and a cooling device for cooling the bag sealed by the heat welding type sealer.

Furthermore, the bagging table includes a printing device for printing letters on the bag; and a deaerator for deaerating air in the bag filled with the food.

Furthermore, the bagging table includes a filling table and a carrying table. The carrying table includes carrying means for carrying the bag, and the heat welding type sealer heats and seals the opening side end of the bag carried by the carrying means.

Furthermore, a space is provided below a carrying-out side end of the carrying means.

Furthermore, the cooling device includes a water tank for accommodating the bag; an ice making machine for supplying ice chips to the water tank; an ice making machine pump for sucking water into the water tank and for supplying the sucked water to the ice making machine; and a stirring device for stirring the water in the water tank.

The cooking apparatus further comprises: a filling start operation switch; filling time setting means for setting a filling time; and a controller. The controller is for driving a carrying pump motor, rotating the carrying pump and opening the filling valve during the filling time set by the filling time setting means from an input of a filling start signal by the filling start operation switch. The carrying pump motor is frequency controlled by an inverter device.

A discharge port of the filling valve has a double structure of an inner cylinder and an outer cylinder, the food flows in the inner cylinder of the filling valve, and the outer cylinder is arranged so that the outer cylinder and an outer surface of the inner cylinder may be spaced.

Furthermore, the bag is cylindrical in shape, and the end of the bag is flatly overlapped and welded.

DETAILED DESCRIPTION OF THE PREFERRED EMBODIMENTS

Figure 1:
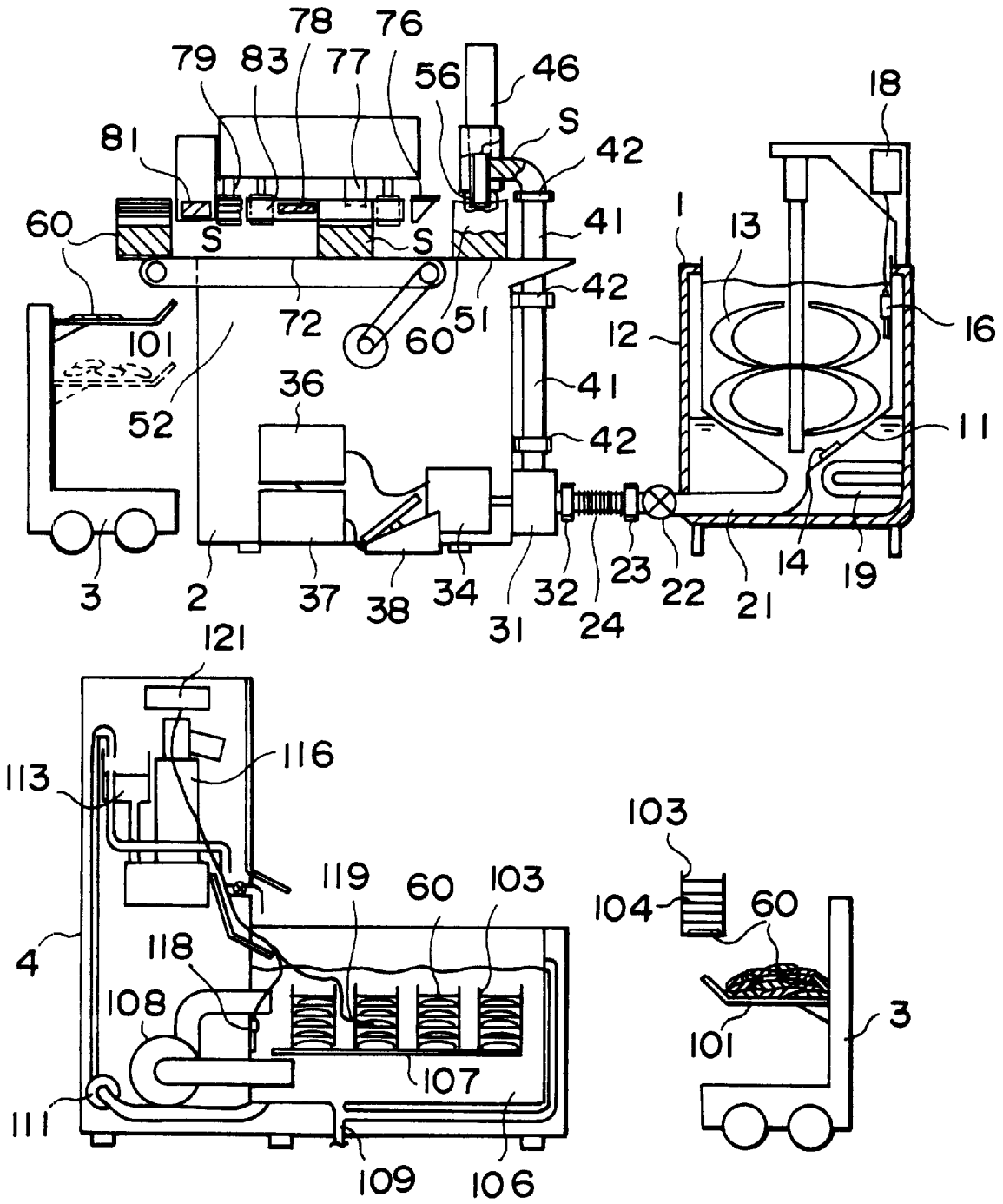
FIG. 1 is a system diagram of a cooking apparatus according to an embodiment of the present invention.
Figure 2:
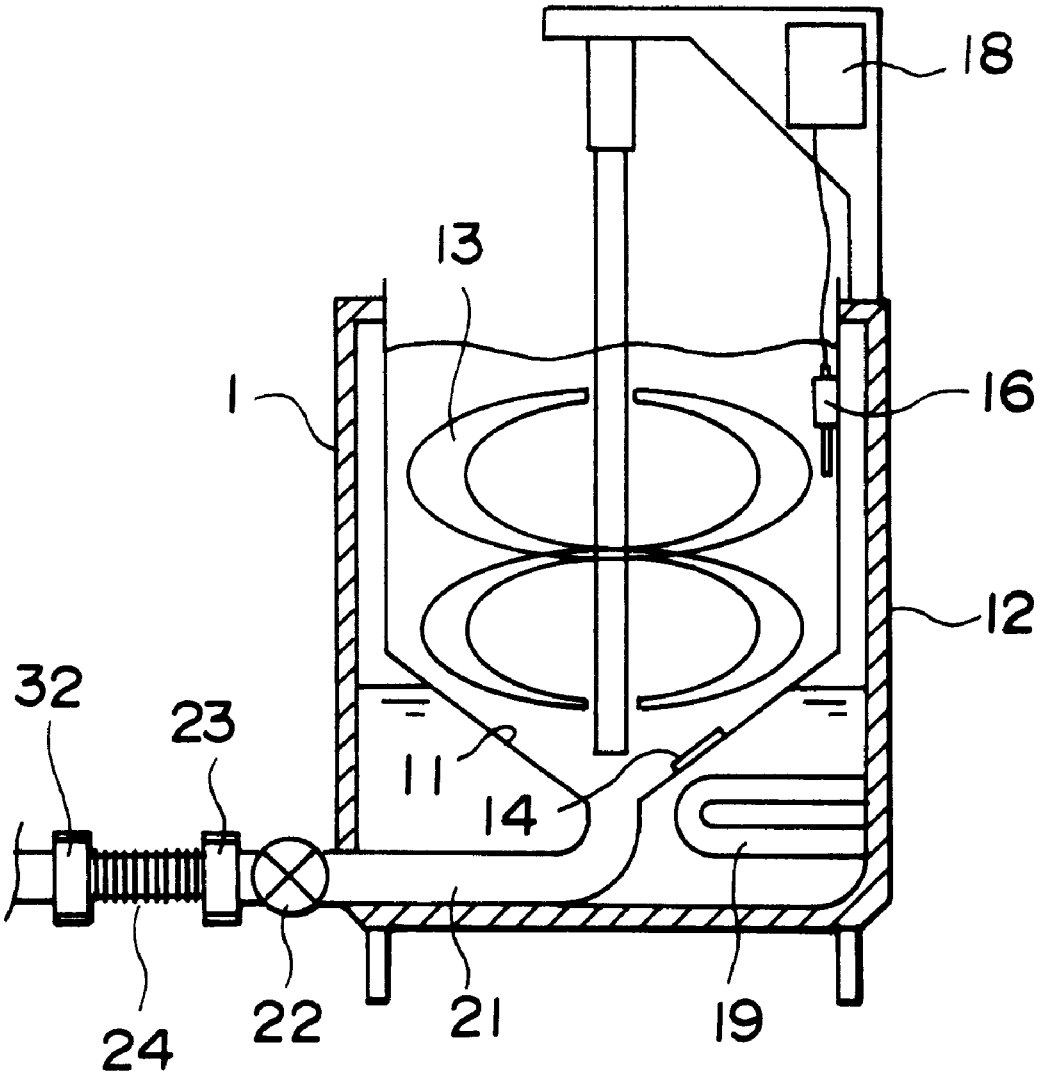
FIG. 2 is a cross sectional view of a kettle.
Figure 3:
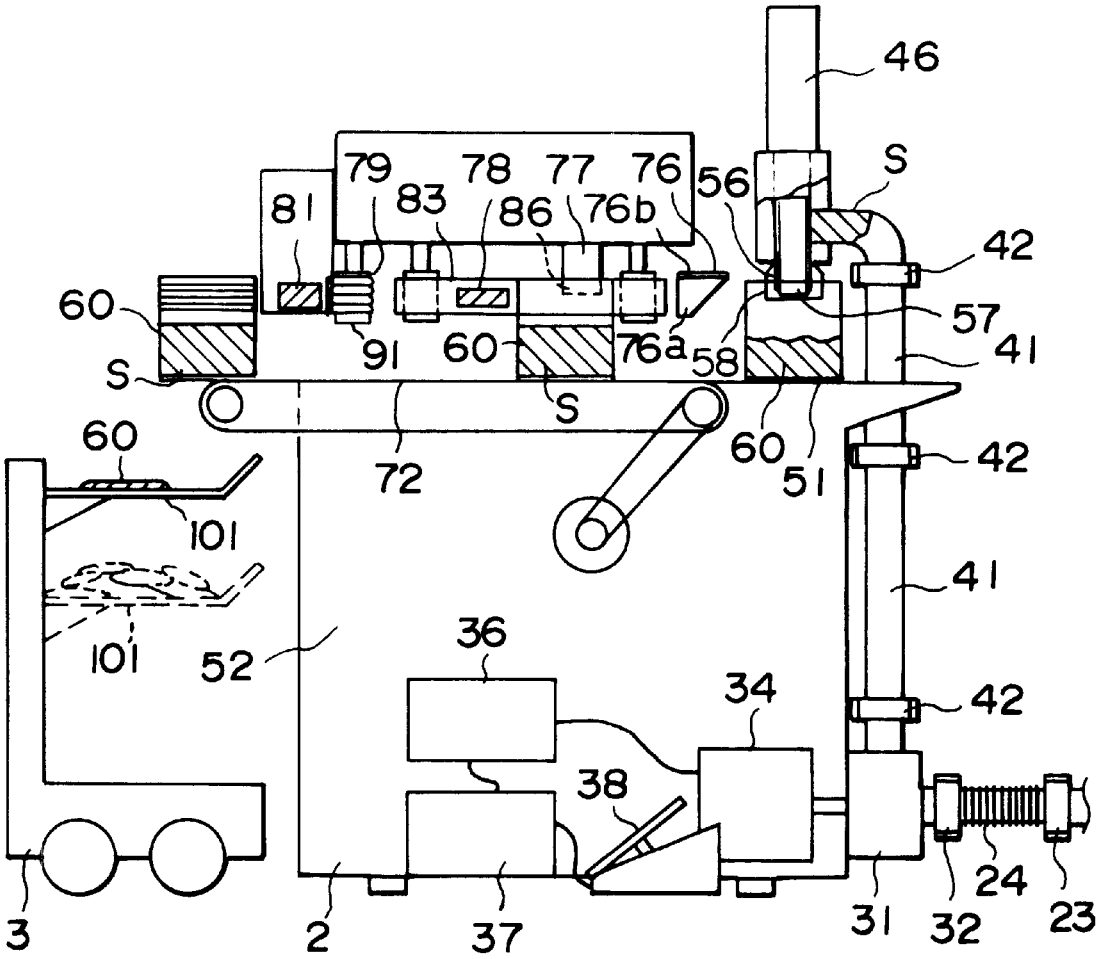
FIG. 3 is a partially cutaway front view of a bagging table and a carrying truck.
Figure 4:
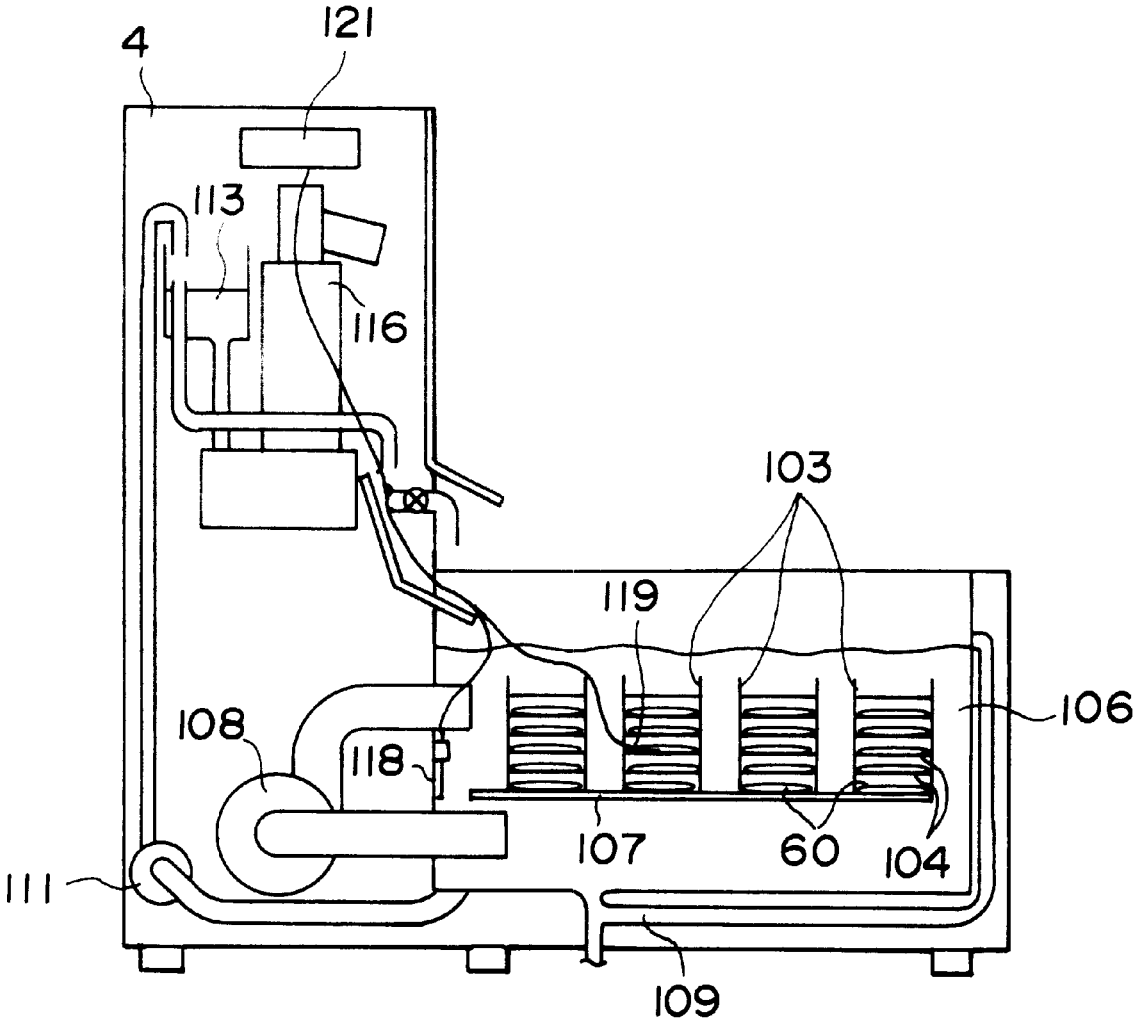
FIG. 4 is a cross sectional view of a cooling device.
Figure 5A:
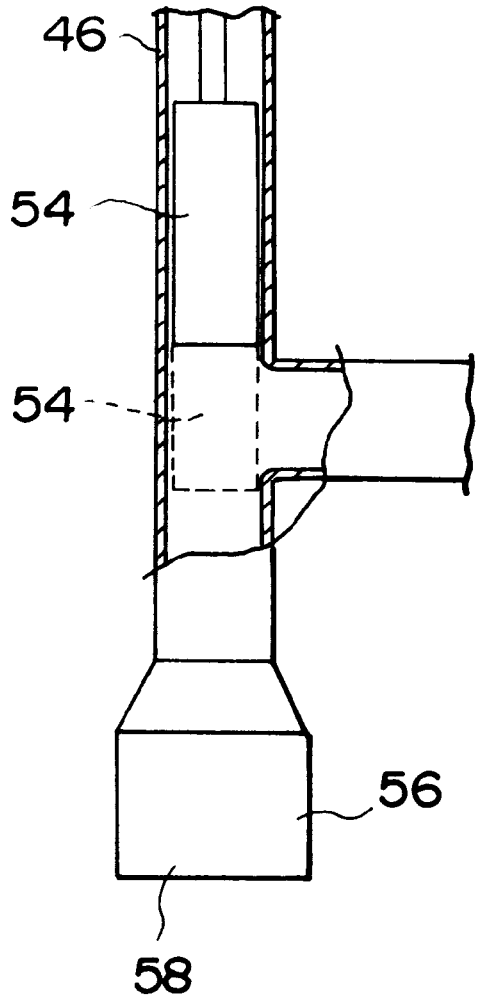
FIGS. 5(*a*)–5(*c*) are illustrations of a filling valve, FIG. 5(*a*) is a partially cutaway front view, FIG. 5(*b*) is a partially cutaway front view of a discharge port and FIG. 5(*c*) is a plan view of the discharge port.
Figure 5B:
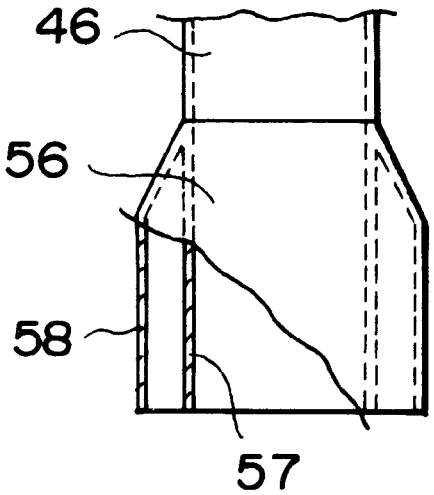
Figure 5C:
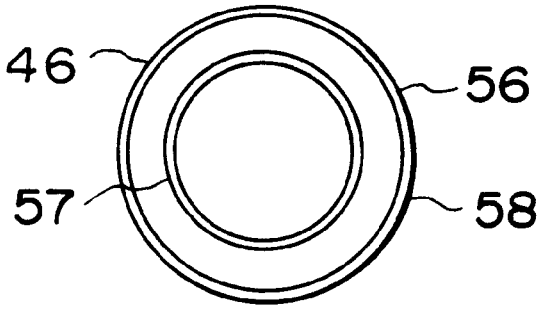
Figure 6:
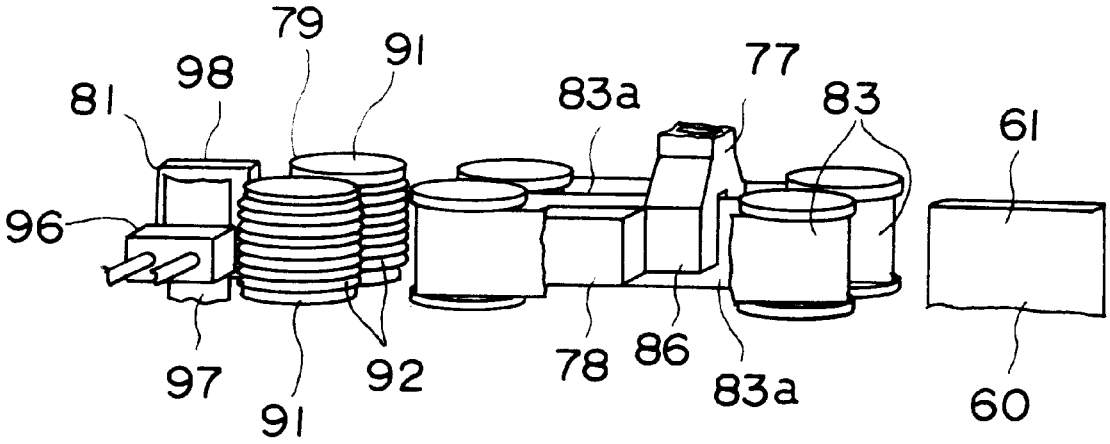
FIG. 6 is a perspective view of a deaerator, a heat welding type sealer and a printing device.

An embodiment of a cooking apparatus according to the present invention will be described below with reference to FIGS. 1 through 8.

The cooking apparatus installed in a hospital kitchen, a restaurant kitchen or the like comprises a kettle 1 for cooking food by heat, a bagging table 2, a carrying truck 3 and a water cooling device 4. The food S to be cooked is liquid food such as soup, rice gruel and curry. The kettle 1 has a double structure of an inner kettle 11 and an outer kettle 12. In the inner kettle 11, a stirrer 13 is rotatably arranged and a thermostat 14 and a temperature sensor 16 are also disposed. A temperature in the inner kettle 11 detected by this temperature sensor 16 is recorded in a kettle temperature recording device 18. On the other hand, water is contained in a space between the inner kettle 11 and the outer kettle 12. A kettle heater 19 is also disposed in the space. This kettle heater 19 is temperature controlled by the thermostat 14. A discharge pipe 21 extends from a bottom of the inner kettle 11 toward an outside of the outer kettle 12. An on-off valve 22 is disposed on an end of the discharge pipe 21. One end of a flexible hose 24 is coupled to the end of the discharge pipe 21 by a ferrule coupler 23.

The water, foodstuffs, flavoring materials or the like are introduced into the inner kettle 11 of the kettle 1 and are then stirred by a rotation of the stirrer 13. On the other hand, the water is contained in the space between the inner kettle 11 and the outer kettle 12. The water is heated by the kettle heater 19, whereby the water is changed into hot water and steam. These hot water and steam are used so as to thereby cook the food in the inner kettle 11. When a cooking is completed, the on-off valve 22 which has been so far closed is opened The food S cooked in the inner kettle 11 is then flowed toward the side of the bagging table 2 through the discharge pipe 21 and the flexible hose 24.

A carrying pump 31 is disposed on the bagging table 2. A suction port of this carrying pump 31 is coupled to the above-described flexible hose 24 by a ferrule coupler 32, whereby the suction port is connected to the side of the kettle 1. A foot pedal 38 which is a filling start operation switch is connected to a carrying pump motor 34 for rotating/driving the carrying pump 31 through a controller 37 such as an inverter device 36 and a microcomputer. A plurality of stainless pipes 41 are also coupled in series to a discharge port of the carrying pump 31 by a ferrule coupler 42. A filling valve 46 is coupled to the end of the pipe 41.

The bagging table 2 comprises a filling table 51 and a carrying table 52 on the right and left sides thereof, respectively. The filling valve 46 is arranged over the filling table 51 so that it may provide the space. In the filling valve 46, an air-pressure type piston 54 for blocking or allowing a flow is disposed so that it may be vertically movable. A discharge port 56 of the filling valve 46 has the double structure of an inner cylinder 57 and an outer cylinder 58. The outer cylinder 58 is arranged so that the outer cylinder 58 and an outer surface of the inner cylinder 57 may be spaced.

Figure 7A:
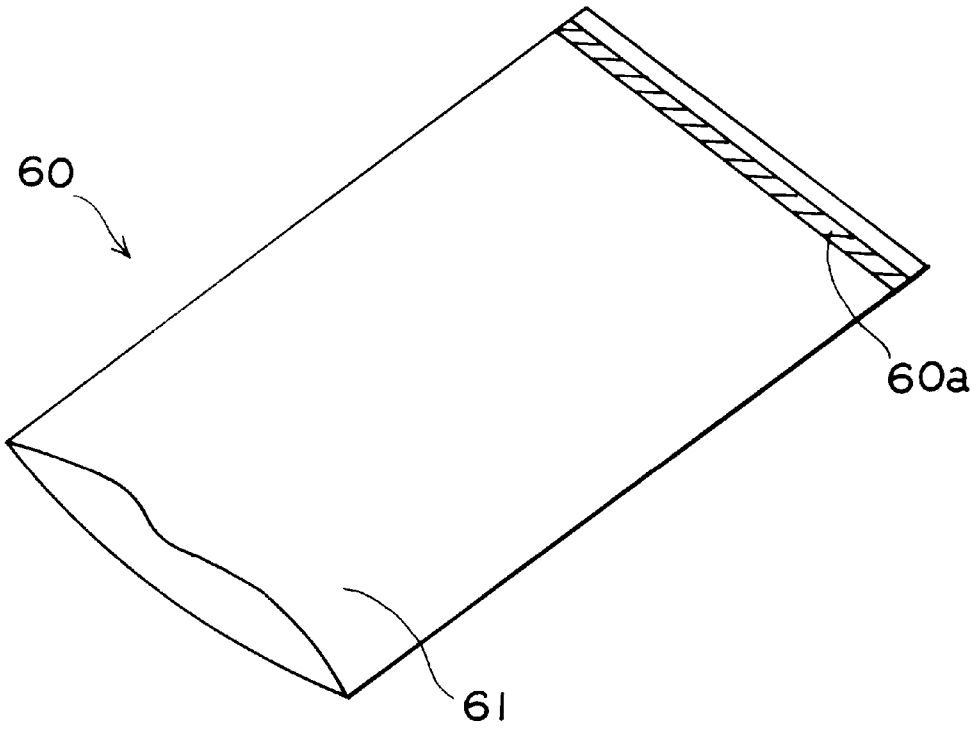
FIGS. 7(*a*)–7(*b*) are illustrations of a bag, FIG. 7(*a*) is a perspective view of the bag before being filled and FIG. 7(*b*) is a perspective view of the bag after filled.
Figure 7B:
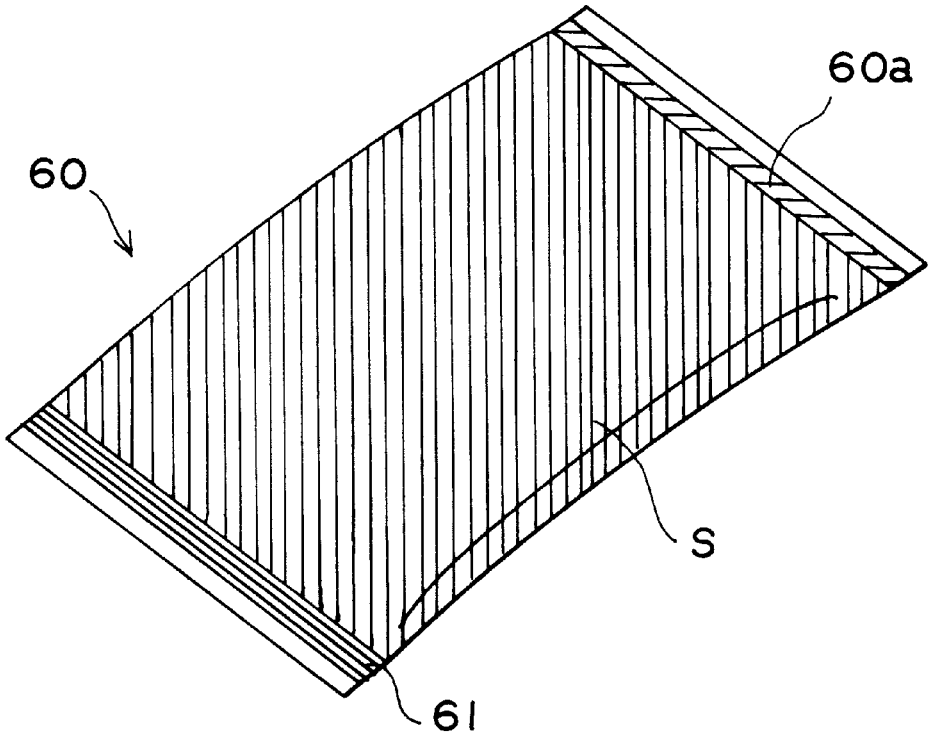

A bag 60 to be filled with the food S by the filling valve 46 is made of resin such as polyethylene. As shown in FIG. 7(*a*), the bag 60 is cylindrical in shape. One end 60*a* is flatly overlapped and welded by heat. The other end 61 is opened. Although a detail will be described below, as shown in FIG. 7(b), the opening side end 61 is also flatly overlapped and welded by heat after a filling of the food S.

Figure 8:
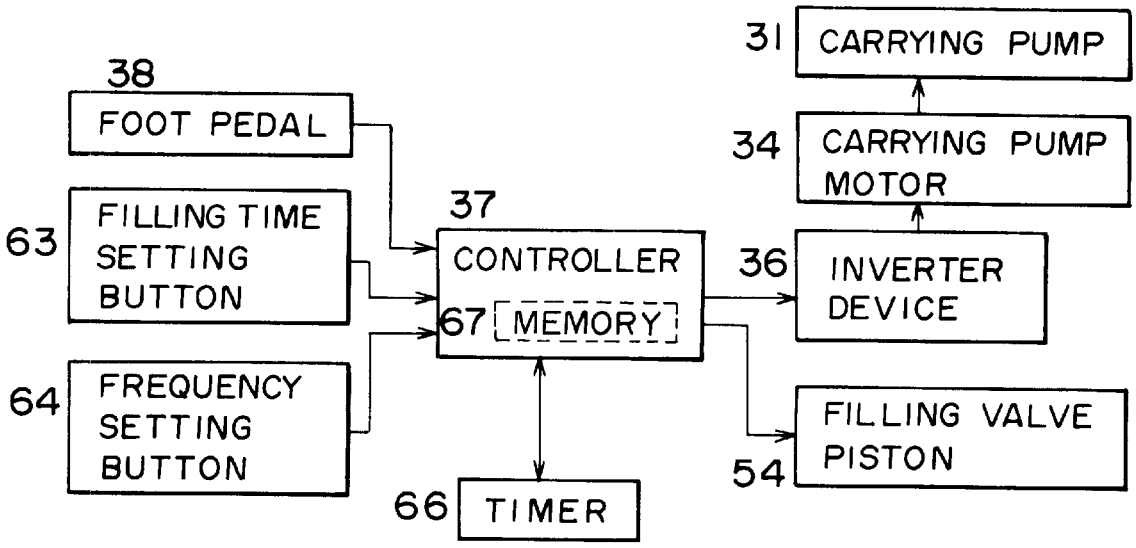
FIG. 8 is a circuit diagram of a controller.

The carrying pump 31 and the piston 54 of the filling valve 46 are controlled by the controller 37 such as the microcomputer. As shown in FIG. 8, the foot pedal 38, a filling time setting button 63 which is filling time setting means and a frequency setting button 64 which is frequency setting means are connected to an input side of the controller 37. On the other hand, the inverter device 36 and the piston 54 of the filling valve 46 are connected to an output side of the controller 37. The controller 37 and a timer 66 input/output a signal to/from each other. A memory 67 is also incorporated in the controller 37. A filling time that the filling valve 46 fills the food in the bag 60 is set in the memory 67 in the controller 37 by the filling time setting button 63. A frequency of a power to be supplied to the carrying pump motor 34 is set in the memory 67 in the controller 37 by the frequency setting button 64.

In such a filling device, the opening of the bag 60 is fitted to the discharge port 56 of the filling valve 46. The foot pedal 38 is then depressed, whereby a filling start signal is output from the foot pedal 38 to the controller 37. When the filling start signal is input to the controller 37, the controller 37 outputs an open signal to a driving device of the piston 54 and outputs a drive start signal and a frequency signal to the inverter device 36.

The power inverted into the frequency set by the filling time setting button 63 is then supplied from the inverter device 36 to the carrying pump motor 34. The carrying pump motor 34 rotates/drives the carrying pump 31. The rotation of the carrying pump 31 allows the food S to be sucked from the side of the kettle 1. The food S is supplied to the filling valve 46 through the pipe 41. As shown by solid lines in FIG. 5, the piston 54 is upward moved. A flow path of the filling valve 46 is opened. The food S supplied from the carrying pump 31 is discharged from the discharge port 56 and is filled in the bag 60.

A time is counted by the signal of the timer 66 from the time when the filling start signal is input to the controller 37. When the filling time set in the memory 67 passes, the controller 37 outputs a close signal to the driving device of the piston 54 and outputs a filling completion signal to the inverter device 36. The inverter device 36 blocks a supply of the power to the carrying pump motor 34. On the other hand, the piston 54 is downward moved as shown by broken lines in FIG. 5. The flow path of the filling valve 46 is closed. The filling of the food S into the bag 60 is completed. During the filling, the bottom of the bag 60 is put on the filling table 51 of the bagging table 2. Almost all load of the food S is applied to the filling table 51. This reduces the load to be applied to hands or the like supporting the opening side end 61 of the bag 60.

The carrying table 52 of the bagging table 2 will be described below. On an upper surface of the carrying table 52, a belt conveyer 72 is disposed as carrying means so that a carrying surface may be generally horizontal. A carrying-out side end of the belt conveyer 72 is overhung from the end of the carrying table 52. The space is provided under the carrying-out side end of the belt conveyer 72. The carrying truck 3 can go in and out of the space.

A positioning member 76, a deaerator 77, a seal heating device 78, a seal press-bonding device 79 and a printing device 81 are arranged in this order at substantially the same height over the belt conveyer 72 so that the space may be provided between them and the upper surface of the belt conveyer 72 and they may extend from a carrying-in side end toward the carrying-out side end. The seal heating device 78 and the seal press-bonding device 79 constitute a heat welding type sealer. The positioning member 76 is L-shaped in cross section. The positioning member 76 is generally vertically extended. The positioning member 76 comprises a rear surface positioning portion 76*a* and an upper end positioning portion 76*b*. The rear surface positioning portion 76*a* is for positioning a rear surface of the bag 60. The upper end positioning portion 76*b* is extruded from an upper end of the rear surface positioning portion 76*a* toward a front side and for positioning the upper end of the bag 60.

A pair of belt conveyers 83 is disposed in a portion where the deaerator 77 and the seal heating device 78 are located. A pair of belt conveyers 83 is overlapped so that the carrying surfaces thereof may be opposite to each other. A carrying surface forming side belt 83*a* forming the carrying surface of the belt conveyer 83 is generally vertically located. A carrying direction of the belt conveyer 83 is substantially the same as the carrying direction of the belt conveyer 72. Carrying velocities of them are synchronized to each other. A pair of legs 86 is disposed on a lower portion of the deaerator 77. A pair of belt conveyers 83 is located between the legs 86. The suction port is provided on a joint portion of the legs 86. One seal heating device 78 each is arranged on an outer side of the carrying surface forming side belt 83*a*, that is, the side opposite to the carrying surface.

The seal press-bonding device 79 comprises a pair of rollers 91 located on the left and right sides in the carrying direction. The rollers 91 are in contact with each other. The roller 91 is cylindrical in shape. A rotating axis of the roller 91 is generally vertically arranged. Ring-shaped protruded threads 92 extend in a circumferential direction on outer peripheral surfaces of the rollers 91 so that they may be vertically provided at multi-stage. The printing device 81 comprises a printing portion 96 having the heating device, an ink ribbon 97 and a bag support member 98 which is a press plate. The bag is put between the ink ribbon 97 and the bag support member 98. The printing portion 96 presses against the bag 60 through the ink ribbon 97, whereby letters are printed on the bag 60.

The bag 60 filled with the food S by the filling valve 46 is put on the carrying-in side end of the belt conveyer 72 of the carrying table 52. The opening side end 61 of the bag 60 is also positioned by the positioning member 76. That is, the upper end of the opening side end 61 of the bag 60 is brought into contact with a lower surface of the upper end positioning portion 76*b*. The rear surface of the opening side end 61 of the bag 60 is brought into contact with a front surface of the rear surface positioning portion 76*a*. As the belt conveyers 72 are moved, the bag 60 is carried out toward the carrying-out side. The opening side end 61 of the bag 60 is pinched and supported between a pair of belt conveyers 83. The bag 60 is moved together with the belt conveyers 83. The bag 60 is moved to the deaerator 77 by the belt conveyers 72, 83. An air in the bag 60 is sucked by the deaerator 77. The air in the bag 60 is substantially completely deaerated by the deaerator 77. Next, the seal heating device 78 heats the opening side end 61 of the bag 60 through the carrying surface forming side belt 83*a*. Since the belt conveyers 83 are moved, the temperature in the whole belt conveyers 83 rises by the seal heating device 78. Therefore, the opening side end 61 of the bag 60 is not only heated when it is located in a place where the seal heating device 78 is set but also is heated at all times when it is pinched between the belt conveyers 83. The opening side end 61 of the bag 60 can be heated for a relatively long time. This allows a heat welding to be facilitated.

The bag 60 with the opening side end 61 heated is delivered from the belt conveyers 83 to the seal press-bonding device 79. The opening side end 61 of the bag 60 is pressed by the seal press-bonding device 79, whereby it is sealed by heat. A plurality of protruded threads 92 are disposed on the rollers 91 of the seal press-bonding device 79 so as to thereby form an unevenness on the rollers 91. A press by both the rollers 91 and the unevenness can ensure the heat welding. The sealed bag 60 is carried to the printing device 81 by the belt conveyers 72. A date of production, a product name or the like is then printed oil the opening side end 61 of the bag 60, that is, a seal portion. The bag 60 drops onto a loading plate 101 of the carrying truck 3 from the carrying-out side end of the belt conveyer 72.

An upward force is applied to the loading plate 101 of the carrying truck 3 by force applying means such as a spring. As shown by the solid lines in FIG. 3, the loading plate 101 is positioned on the upper portion before the bag 60 is loaded on the loading plate 101. As the bag 60 is loaded on the loading plate 101, the loading plate 101 is gradually lowered as shown by the broken lines. When a plurality of bags 60 are loaded on the loading plate 101 of the carrying truck 3, the carrying truck 3 is pushed and moved to a cooling device 4. A single bag 60 or a plurality of bags 60 are then accommodated in multi-stage shelves 104 in racks 103.

The cooling device 4 for cooling the bag 60 accommodated in the rack 103 will be described below. The cooling device 4 is provided with a water tank 106. A rack support portion 107 is disposed in the water tank 106. The rack 103 is put and supported on the rack support portion 107. In such a manner, the rack 103 is stored in the water tank 106. The water is also contained in the water tank 106. A stirring pump 108 which is a stirring device sucks the water in the lower portion of the water tank 106. The sucked water is then discharged to the upper portion of the water tank 106. A drain pipe 109 is also coupled to the bottom and the upper portion of a side wall of the water tank 106. An ice making machine pump 111 sucks the water from the lower portion of the water tank 106. The water is supplied to a chip ice making machine 116 through an ice making machine water tank 113. The chip ice making machine 116 makes ice chips of the supplied water. The ice chips are dropped into the water tank 106. Disposed are a water temperature sensor 118 for detecting a water temperature in the water tank 106 and a bag temperature sensor 119 for detecting the temperature in the bag 60. The temperatures detected by the water temperature sensor 118 and the bag temperature sensor 119 are recorded in an ice making machine temperature recorder 121.

The rack 103 accommodating the bag 60 therein is stored in the water tank 106 in the cooling device 4. When the bag 60 is cooled, the drain pipe 109 is closed by a valve or the like. The water is reservoired in the water tank 106. The chip ice making machine 116 supplies the ice chips into the water tank 106. The stirring pump 108 also stirs the water and the ice chips in the water tank 106. The bag 60 is rapidly cooled. The food S filled in the bag 60 can be cooled from about 80° C. to about 3° C. within 90 minutes. When the water tank 106 is cleaned, the valve or the like of the drain pipe 109 is opened, whereby the water in the water tank 106 is discharged.

In such a manner, the bag 60 cooled by the cooling device 4 is accommodated in the rack 103, while it is taken out from the water tank 106 in the cooling device 4. The bag 60 is then accommodated in a refrigerator and an icebox.

As described above, in this embodiment, the opening side end 61 of the bag 60 is sealed by the heat welding. Since a metallic clip is not used, it is possible to prevent the clip or the like from mixing into the bag 60.

Since the bag 60 is flatly sealed on both the ends thereof, the ends are not rounded. Therefore, the bag 60 can be uniform in thickness. A thicker portion is not thus caused. As a result, cooling efficiency of the bag 60 is improved.

The discharge port 56 of the filling valve 46 comprises the inner cylinder 57 and the outer cylinder 58. The high-temperature food S flows in the inner cylinder 57. The outer cylinder 58 is disposed so that the inner and outer cylinders 57, 58 may be spaced. Accordingly, the temperature in the outer cylinder 58 rises very little. Consequently, when the opening of the bag 60 is fitted to the discharge port 56 so as to thereby fill the food S in the bag 60, even if a worker touches the discharge port 56 with his hands holding the opening side end 61 of the bag 60, the worker feels little hot. Thus, a working environment is improved.

The filling valve 46 is disposed on the bagging table 2. The bag 60 can be thus fitted to the filling valve 46 by the hands, and the food S can be filled in the bag 60. The scale can be relatively small. This can also comply with a small-quantity production. Furthermore, when the bag 60 filled with the food S is supported on the bagging table 2, little juice on the bag 60 adheres to the hands. A filling operation is therefore facilitated.

The kettle 1, the carrying pump 31 and the filling valve 46 are coupled to one another by the ferrule couplers 23, 32, 42, the flexible hose 24 and the stainless pipe 41. Since they can be easily disassembled, a cleaning is facilitated.

The bags 60 are accommodated in a plurality of shelves 104 in the racks 103. The bags 60 are cooled by the cooling device 4. The bags 60 are stacked very little. Thus, a cooling can be efficiently performed. The bags 60 are not dispersed in the water tank 106. The bags 60 can be therefore easily withdrawn. Moreover, the cooled bag 60 is accommodated in the rack 103, while the bag 60 can be accommodated in the refrigerator or the like. Working efficiency is thus improved. Furthermore, since the ice chips are put in the water tank 106 in the cooling device 4, the cooling efficiency is improved compared to the apparatus in which the bag 60 is cooled from a periphery of the water tank 106. Moreover, since the water in the water tank 106 is stirred by the stirring pump 108, the cooling efficiency is further improved.

The frequency of the power to be supplied to the carrying pump motor 34 for driving the carrying pump 31 can be changed by the inverter device 36. This frequency is set by the frequency setting button 64. Therefore, the frequency can be adjusted in accordance with viscosity of the food S. For example, when the viscosity is higher, the frequency can be highly set. When the viscosity is lower, the frequency can be lowly set.

The printing device 81 is a heat transfer type. The printing device 81 also prints the letters on a heat seal portion on the bag 60. The heat in the heat seal portion can be thus used, whereby a capacity of the heater of the printing device 81 can be reduced.

The filling table 51 and the carrying table 52 are continuously connected to each other. Thus, the bag 60 filled with the food S can be substantially automatically deaerated. The seal, printing or the like can be then performed. Furthermore, the carrying-out side end of the belt conveyer 72 of the carrying table 52 is outward overhung. Therefore, the carrying truck 3 or the like is put under the carrying-out side end of the belt conveyer 72, whereby the bag 60 can be automatically loaded on the carrying truck 3.

The filling time is changed by the filling time setting button 63, whereby the food S can be filled in the bags 60 of various capacities.

Since the chip ice making machine 116 uses the water in the water tank 106, a level in the water tank 106 is not changed. Accordingly, it is not necessary to frequently adjust the level.

Although the embodiment of the present invention is described above, the present invention is not limited to the above-mentioned embodiment. It should be understood that various changes and variations can be made in the present invention without departing from the spirit and scope of the present invention as defined by the appended claims. The variations of the present invention will be described below.

(1) Although the printing device 81 is disposed on the carrying-out side of the deaerator 77, the seal heating device 78 and the seal press-bonding device 79 in the embodiment, the printing device 81 can be disposed on the carrying-in side. However, when the printing device 81 is disposed on the carrying-out side, the heat in the seal heating device 78 can be used. The heat of the heater can be thus reduced during a heat transfer.

(2) The carrying truck 3 is not always required.

(3) The food S is the liquid food such as the curry and the rice gruel in the embodiment. However, as long as the food S is the liquid food, the kind of the food S to be cooked can be appropriately selected.

According to the cooking apparatus of the present invention, the food is cooked by heat in the kettle. The cooked food is carried into the filling valve (filling portion) of the bagging table by the carrying pump. The food is filled in the bag. The bag filled with the food is sealed on the opening side end thereof by the heat welding type sealer. The bag is then cooled by the cooling device. Therefore, a processing from the bagging to the cooling can be performed by this cooking apparatus. Moreover, since the metallic clip or the like is not used, it is possible to prevent a metal from mixing into the bag. Furthermore, since the food can be filled in the bag on the bagging table, a relatively small amount of bags can be also produced. The scale can be also relatively small.

When the printing device for printing the letters on the bag and the deaerator for deaerating the air in the bag filled with the food are disposed on the bagging table, the printing of the bag and the deaeration of the air in the bag can be also performed.

The bagging table comprises the filling table and the carrying table. The carrying table includes the carrying means for carrying the bag. The heat welding type sealer heats and seals the opening side end of the bag carried by the carrying means. In this case, the filling of the food into the bag can be manually performed on the filling table. The bag filled with the food is also moving by the carrying means, while it is automatically sealed. Thus, since an automation of a filling operation causes facilities to be enlarged, the filling is manually operated. On the other hand, since the automation of a sealing operation does not cause the facilities to be enlarged, the sealing is automated. Accordingly, the scale can be relatively reduced. Productivity is also improved. It is therefore possible to achieve the cooking apparatus suitable for the installation in the kitchen in the hospital, the restaurant or the like.

When the space is provided under the carrying-out side end of the carrying means, the carrying truck or the like can be put under the carrying-out side end of the carrying means. Therefore, the bag can be dropped directly onto the carrying truck or the like from the carrying means. Accordingly, the working efficiency is improved.

In some cases, the cooling device includes the water tank for accommodating the bag, the ice making machine for supplying the ice chips to the water tank, the ice making machine pump for sucking the water in the water tank and for supplying the sucked water to the ice making machine, and the stirring device for stirring the water in the water tank. The ice chips are mixed in the water in the water tank and the ice chips and the water are then stirred by the stirring device, whereby the bag can be efficiently cooled. Furthermore, since the ice making machine makes the ice chips by the use of the water in the water tank, the level in the water tank is changed very little. Therefore, it is not necessary to frequently adjust the level. A labor and a time for a level control can be omitted.

Provided are the filling start operation switch, the filling time setting means for setting the filling time, and the controller. The controller is for driving the carrying pump motor, rotating the carrying pump and opening the filling valve during the filling time set by the filling time setting means from the input of the filling start signal by the filling start operation switch. The carrying pump motor is frequency controlled by the inverter device. In this case, the filling time is changed, whereby the quantity of the foods to be filled in the bags can be easily changed. Moreover, the frequency of the power to be supplied to the carrying pump motor can be changed by the inverter device in accordance with the viscosity of the food. Even if the viscosity of the food is changed, the food can be filled in the bag at an appropriate speed.

The discharge port of the filling valve has the double structure of the inner cylinder and the outer cylinder. The food flows in the inner cylinder of the filling valve. The outer cylinder is arranged so that the outer cylinder and the outer surface of the inner cylinder may be spaced. In this case, little heat of the food flowing in the inner cylinder transfers to the outer cylinder. Therefore, the temperature in the outer cylinder rises very little. Even if the worker touches the filling valve with his hands holding the opening side end of the bag, the worker feels little hot. Thus, the working environment is improved.

The bag is cylindrical in shape, and the end of the bag is flatly overlapped and welded. In this case, the bag is uniform in thickness. The thicker portion is not thus caused. As a result, the cooling efficiency of the bag is improved.

What is claimed is:

1. A cooking apparatus comprising:

a kettle for cooking food by heat;

a carrying pump for carrying the food cooked by said kettle;

an automated filling portion including a double structured discharge port filling portion for filling the food carried by said carrying pump into a bag;

a heat welding type sealer for heating and sealing an opening side end of said bag filled with the food by said filling portion; and a cooling device for cooling said bag sealed by said heat welding type sealer comprising:

a tank for accommodating a filled bag;

an ice making machine for supplying ice chips to said tank;

an ice making machine pump for sucking water in said tank produced by the melting of the ice chips and for supplying the sucked water to said ice making machine; and a stirring device for stirring the water in said tank.

2. The cooking apparatus according to claim 1 further comprising:

a filling start operation switch;

filling time setting means for setting a filling time; and a controller for driving a carrying pump motor, rotating said carrying pump and opening said filling valve during the filling time set by said filling time setting means from an input of a filling start signal by said filling start operation switch, wherein said carrying pump motor is frequency controlled by an inverter device.

3. The cooking apparatus according to claim 1, wherein a discharge port of said filling valve has a double structure of an inner cylinder and an outer cylinder, the food flows in said inner cylinder of said filling valve, and said outer cylinder is arranged so that said outer cylinder and an outer surface of said inner cylinder may be spaced so that an annular gap exists therebetween said outer cylinder and said outer surface of said inner cylinder.

4. The cooking apparatus according to claim 1, wherein said bag is cylindrical in shape, and the end of said bag is flatly overlapped and welded.

5. A cooking apparatus comprising:

a kettle for cooking food by heat;

a bagging table for bagging the food cooked by said kettle;

a carrying pump for carrying the food cooked by said kettle;

an automated filling portion including a filling valve disposed on said bagging table for filling the food carried by said carrying pump into a bag;

a heat welding type sealer disposed on said bagging table for heating and sealing an opening side end of said bag filled with the food by said filling valve; and a cooling device for cooling said bag sealed by said heat welding type sealer comprising:

a tank for accommodating a filled bag;

an ice making machine for supplying ice chins to said tank;

an ice making machine pump for sucking water in said tank produced by the melting of the ice chips and for supplying the sucked water to said ice making machine; and a stirring device for stirring the water in said tank.

6. The cooking apparatus according to claim 5, wherein said bagging table includes:

a printing device for printing letters on said bag; and a deaerator for deaerating an air in said bag filled with the food.

7. The cooking apparatus according to claim 5 or 6, wherein said bagging table includes a filling table and a carrying table, said carrying table includes carrying means for carrying said bag, and said heat welding type sealer heats and seals the opening side end of said bag carried by said carrying means.

8. The cooking apparatus according to claim 7, wherein a space is provided below the carrying-out side end of said carrying means.

* * * * *